United States Patent [19]

Knoll

[11] 4,344,255

[45] Aug. 17, 1982

[54] WINDOW SASH

[75] Inventor: Harold H. Knoll, Freeburg, Mo.

[73] Assignee: Quaker Window Products Co., Freeburg, Mo.

[21] Appl. No.: 179,072

[22] Filed: Aug. 18, 1980

[51] Int. Cl.[3] ..... E06B 3/00

[52] U.S. Cl. ..... 49/501; 49/453

[58] Field of Search ..... 49/501, 450, 453, 465; 160/90, 91, 381

[56] References Cited

U.S. PATENT DOCUMENTS

| | | | |
|---|---|---|---|
| 1,824,900 | 9/1931 | Kaufman . | |
| 2,740,998 | 4/1956 | Zitomer | 49/453 |
| 2,965,935 | 12/1960 | Olsen | 49/450 |
| 3,083,419 | 4/1963 | Pennington et al. | 49/450 |
| 3,300,900 | 1/1967 | Risk et al. | 49/501 X |
| 3,342,514 | 9/1967 | Ivanhoe et al. | 49/501 X |
| 3,373,529 | 3/1968 | Ingham | 49/381 |
| 4,087,941 | 4/1977 | Wolfe | 49/450 |

*Primary Examiner*—Philip C. Kannan

*Attorney, Agent, or Firm*—Senniger, Powers, Leavitt and Roedel

[57] ABSTRACT

A sash adapted to be received in an opening in a window or the like having channels constituting tracks for the sash at opposite sides of the opening. The sash comprises a pair of side members, a pair of cross members, and fasteners for securing the side and cross members together at corner joints of the sash. The fasteners at the ends of a cross member comprise a pair of screws each having a threaded shank and a head. The shank of each screw extends through a hole in one of the side members and is received in threaded engagement in an opening in the end of the cross member. The head of each screw projects out from the respective side member, has an inner face in engagement with the side member and is adapted to be received in one of the tracks in sliding engagement for enabling sliding movement of the sash in the tracks.

12 Claims, 4 Drawing Figures

13
15
17
19
21
23
25
27
29
31
32
33
34
35
37
39
41
43
45
47
49
51
53
55
57
59
61

WINDOW SASH

BACKGROUND OF THE INVENTION

This invention relates to a window sash, and more particularly to a sash slidable in tracks at opposed sides of an opening in a window or the like.

This invention involves an improvement upon the prior art sash of the type, such as shown for example in U.S. Pat. No. 4,087,941, comprising a pair of side members, a pair of cross members, and means for securing the side and cross members together at corner joints of the sash. The side and cross members are channel shaped aluminum extrusions, and the securing means comprises a L-shaped member of die cast aluminum at each corner of the sash, the legs of each L-shaped member being adapted to be received in the side and cross members at the respective corner joint of the sash in a force fit relation. A problem with the prior art sash is that its initial assembly, and its reassembly such as for the replacement of a broken pane of glass, are difficult and time-consuming operations, especially for a sash intended to hold a large pane of glass which may be easily broken when forces are applied to the sash to insert the L-shaped members into the side and cross members. Moreover, the reassembly of a sash, in many instances, is performed by a homeowner and involves the use of a hammer of mallet which increases the likelihood of glass breakage. Another problem with the prior sash is that the L-shaped members have projections for holding the sash in the tracks in the window in slidng engagement therewith which projections are subject to being sheared from the L-shaped members during the use of the sash. Disassembly and reassembly of the sash are required for replacement of an L-shaped member having a damaged projection.

SUMMARY OF THE INVENTION

Among the several objects of this invention may be noted the provision of an improved window sash which may be assembled more easily and quickly, and with less risk of breakage of glass than with prior window sash; the provision of such a sash in which the side and cross members are secured together by screws; the provision of such a sash which is assembled by turning the screws to bring the members into engagement at the sash joints, thus enabling assembly of the sash without the application of relatively large forces or hammer blows to the side and cross members at the corner joints of the sash as required in the assembly of prior sash; the provision of such a sash in which the screws have heads constituting projections for holding the sash in the window tracks, which heads are of greater shear strength than the projections of the securing means of prior sash; and the provision of such a sash which is of simple, economical construction.

In general, the sash of this invention comprises a pair of side members, a pair of cross members and means for securing the side and cross members together at joints. The securing means comprises a pair of screws at the joints at the ends of a cross member of the sash. Each screw has a threaded shank and a head, the shank extending through a hole in one of the side members and being received in threaded engagement in an opening in the end of said cross member. The head of each screw projects out from the respective side member, has an inner face in engagement with the side member, and is adapted to be received in one of the tracks in the window in sliding engagement therewith for enabling sliding movement of the sash in the tracks.

Other objects and freatures will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 2:
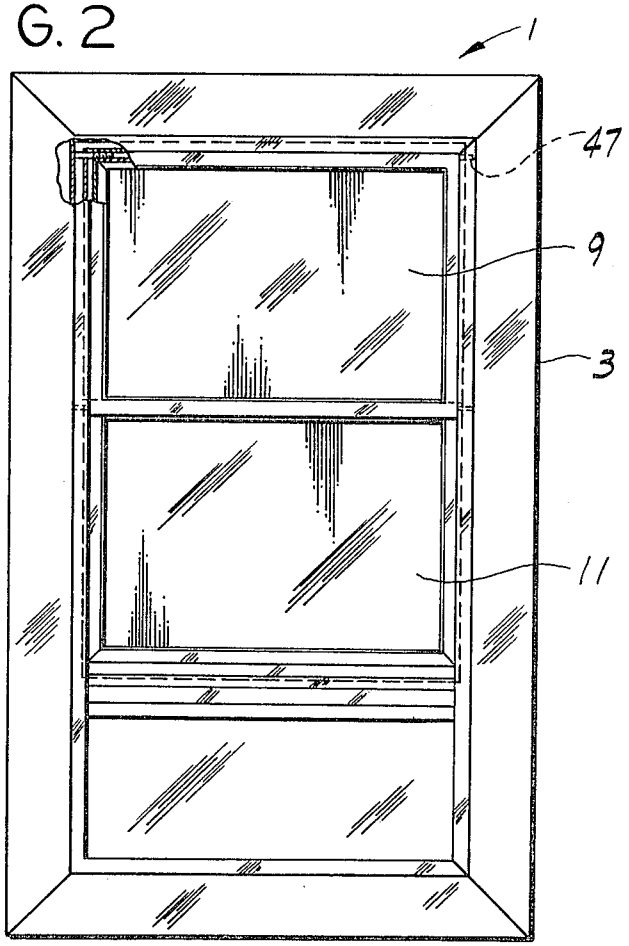
FIG. 2 is an elevation of the outer face of the window assembly with both sashes in the window frame, a portion of the window assembly being shown in section.
Figure 1:
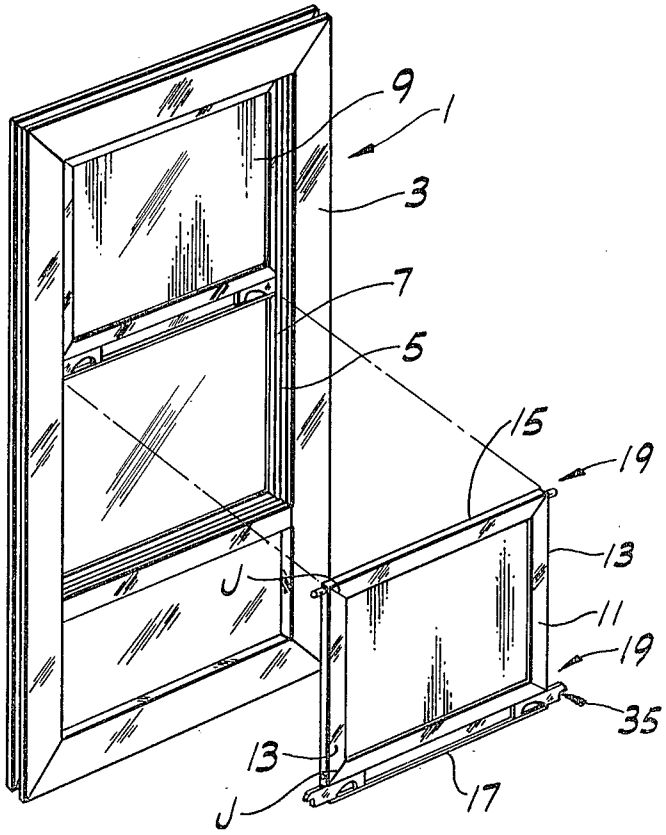
FIG. 1 is a perspective of the inner face of a window assembly including a window frame and a pair of sashes of this invention, one sash being shown spaced from the window frame and the other sash being installed therein.

Referring to the drawings, and more particularly to FIGS. 1 and 2, there is shown a window assembly 1, such as a storm window, comprising a window frame 3 having a pair of grooves or channels constituting inner and outer tracks 5, 7 at opposite sides of an opening in the window frame, and upper and lower sashes of this invention indicated at 9, 11 adapted to be received in the outer and inner tracks 7, 5, respectively, in slidable, pivotable engagement therewith. The sashes 9, 11 are generally identical, and a description of one will suffice for both.

Figures 3, 4:
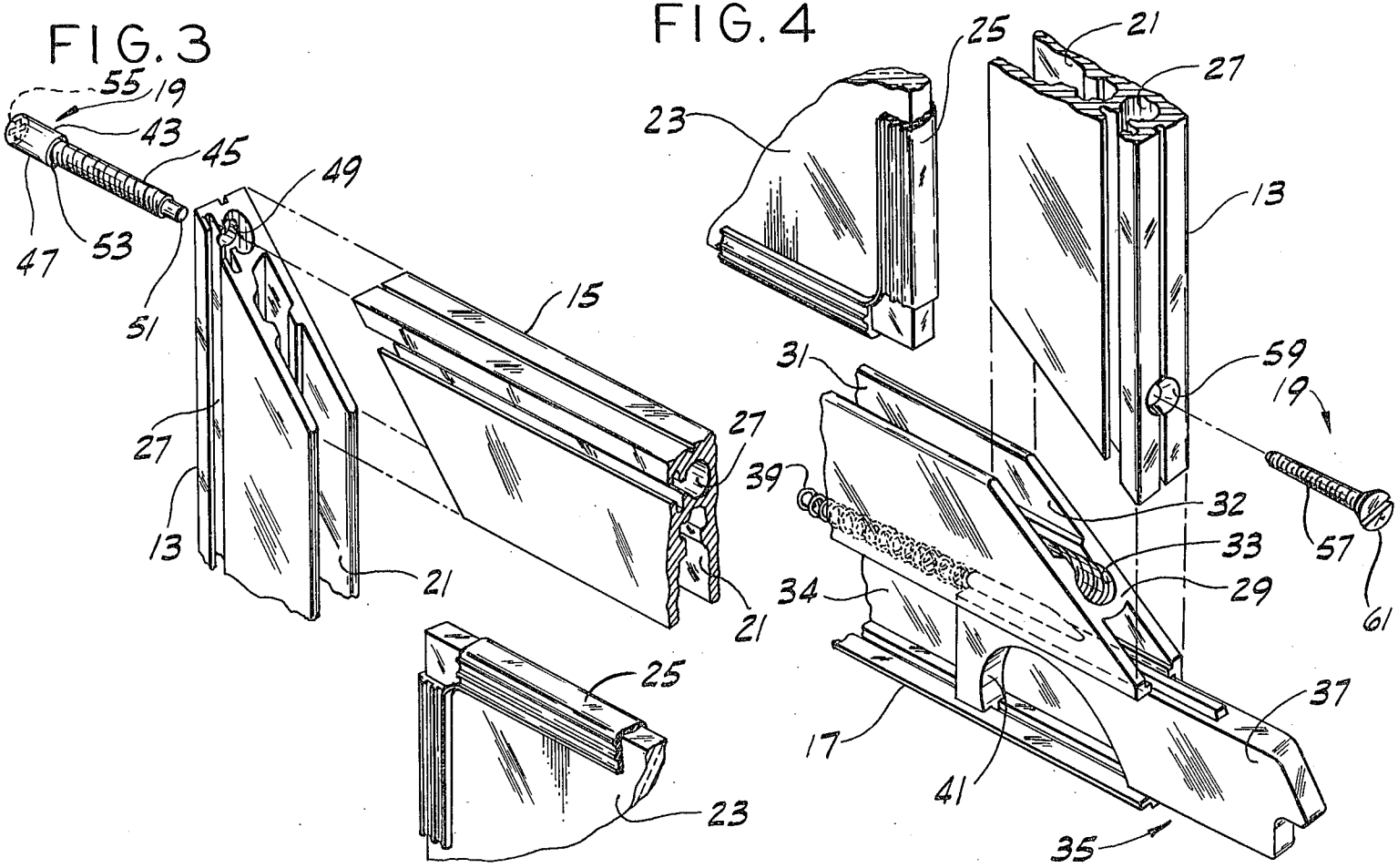
FIG. 3 is an enlarged exploded perspective of an upper corner of one of the sashes.
FIG. 4 is an enlarged exploded perspective of a lower corner of one of the sashes.

The sash 11 comprises a pair of side members 13, an upper cross member 15, a lower cross member 17, and means 19 for securing the side and cross members together at joints J of the sash which are preferably mitered joints. As shown in FIG. 3, the side members 13 and the upper cross member 15 are generally similar in construction, each having a recess 21 at its inner edge extending along the length of the member adapted to receive an edge margin of a pane of glass 23 covered by a protective strip 25 of elastomeric material. Each member further has a recess 27 in its outer face extending the length of the member. Weatherstrip material (not shown) may be inserted into the recess 27. The side members 13 and the upper cross members 15 are preferably extrusions of aluminum, vinyl or other synthetic resin or some other suitable material.

As shown in FIG. 4, the lower cross member 17, which preferably is also an extrusion of aluminum, vinyl or other synthetic resin or some other suitable material, has an upper miter cut surface 29 at each end, a recess 31 in its inner edge having an upper portion 32 for receiving the lower edge margin of the pane of glass 23 and a lower portion 33, and a recess 34 in its inner face. The recess 34 is adapted to receive a pair of latches 35, one at each end of the lower cross member 17. Each latch comprises a plunger 37 slidably mounted in the recess 34 and a compression spring 39 within an upper portion of the recess 34 secured at its inner end to the lower cross member 17 and engaging the plunger at its outer end for biasing the plunger outwardly.

With the sash 11 installed in the opening in the window frame 3, the outer end of each plunger 37 extends outwardly into the tracks 5 and is adapted to be received in one hole of a series of holes (not shown) at spaced intervals along the window tracks 5. The plungers 37, when received in corresponding holes in the tracks 5 at opposite sides of the window opening, hold the sash in the lowered closed position or in a raised open position. At 41 finger-grips are provided in the plungers 37 for enabling the plungers to be moved inwardly by the user against the bias of the springs 39 for withdrawal of the plungers from the holes in the window tracks 7. With the plungers withdrawn, the sash 11 may be raised or lowered to another open position or to the closed position.

In accordance with this invention, the securing means 19 comprises a pair of screws 43 at the upper corner joints J of the sash 11 (i.e., the joints at the ends of the upper cross member 15). Each of the screws has a threaded shank 45 and a head 47 of generally uniform circular section throughout its length. Each side member 13 at the upper end thereof is provided with a hole 49 extending transversely thereof adapted to receive the shank 45 of the respective screw in non-threaded engagement, the hole 49 being in alignment with the recess 27 in the upper cross member 15 when the side member and upper cross member are in engagement to form the joint J. The screws 43 are self-tapping screws and they cut threads in the upper cross member as they are turned in the recesses 27. Each screw 43 at its inner end has a cylindrical projection 51 of smaller diameter than the threaded shank 45 which guides the entry of the screw into the hole 49 and the recess 27 in the cross member 15.

The head 47 of each screw projects laterally outwardly from the respective side member to form a projection adapted to extend for substantially its entire length in the respective track, thereby enabling the window sash 11 to be fitted in the window with its side member 13 closely adjacent the channels of the window and thus with no substantial gap between the side members and the channels, as shown in FIGS. 1 and 2. The head 47 has an inner face 53 which engages the respective side member 13 for holding the mitered end of the side member against that of the upper cross member 15 and means, such as a recess 55 in the outer end thereof adapted to receive means for rotating the screw such as a Phillips head screwdriver. The cylindrical outer surface of the head 47 of each screw is in sliding engagement with the respective track for enabling both sliding movement of the sash in the tracks and swinging movement of the sash 11 in the opening in the window frame 3.

The securing means 19 further comprises a pair of screws 57, such as flat head self-tapping screws, at the lower joints J of the sash. Each side member 13 is provided with a countersunk hole 59 at its lower end adapted to receive the screw 27 in non-threaded engagement, the hole 59 being in alignment with the bottom portion 33 of the recess 31 in the lower cross member 17 when the side and lower cross members are in engagement to form the joint J. Upon tightening the screws 57, the mitered ends of the side members 13 are held against the miter cut surfaces 29 of the lower cross member with the heads 61 of the screws being received in the countersunk holes 59, the outer ends of the heads being generally flush with the outer edges of the side members.

In use, with the sash 11 in the inner tracks 5 in the window frame 3, the sash may be moved in the tracks from its initial position to another open position or to closed position by moving the plungers 37 inwardly to withdraw the outer ends thereof from the holes in the tracks 5, raising or lowering the sash (with the heads of screws sliding in the window tracks) to a position in which the plungers 37 are in alignment with other holes in the tracks 5, and allowing the plungers to move outwardly into these holes in the window tracks. To clean the sash, when in the window frame 3, the plungers are moved inwardly until the outer ends thereof are spaced inwardly of the tracks 5, and the sash is then pivoted upwardly about the heads 47 of the screws 43 to a generally horizontal position in which both faces of the sash are accessible. Lowering one side of the sash relative to the other, when the sash is in its pivoted up position, results in the withdrawal of the head 47 of one of the screws 43 from the tracks and enables removal of the sash 11 from the window frame 3.

Disassembly of the sash 11 such as for replacement of a broken pane of glass 23 is accomplished by removing the screws 43, 57 at opposite corners of the sash and moving the upper cross members 15 and the attached side member 13 away from the lower cross member 17 and the side member 13 attached thereto. The broken pieces of glass 23 may be removed before or after disassembly. Reassembly of the sash is accomplished by placing the protective strip 25 around the edges of the replacement pane of glass 23, pressing the side and cross members 13, 15, 17 inwardly onto the pane of glass with the edge margins of the glass being received in the recesses 21, 31 in the side and cross members, and inserting and turning the screws 43, 57.

While the sash 11 is shown in the drawings as holding a pane of glass 23 and the window assembly as having vertical tracks 7 in which the sash may be raised or lowered, it is contemplated that the sash 11 could hold a piece of screen material and the window assembly 1 may have horizontal tracks with the sash being movable horizontally in the opening in the window. Moreover, while the sash is shown and described as being in an opening in a window, it is contemplated that the sash could be received in an opening in a door such as a storm door.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A sash adapted to be received in an opening in a window or the like having channels constituting tracks for the sash at opposite sides of the opening, the sash comprising:

a pair of side members;

a pair of cross members; and means for securing the side and cross members together at joints, said securing means comprising a pair of screws at the joints at the ends of a cross member of the sash, each screw having a threaded shank and a head of generally uniform circular section throughout its length, the shank extending through a hole in one of said side members and being received in threaded engagment in an opening in the end of said cross member, the head projecting laterally outwardly from the side member, having an inner face in engagement with the side member and means at its outer end adapted to be engaged by means for turning the screw, the head being adapted to extend for substantially its entire length within the respective track thereby enabling the window sash to be fitted in the window with its side members closely adjacent the channels of the window and thus with no substantial gap between the side members and the channels, and having its generally cylindrical outer surface in sliding engagement with the respective track thereby enabling both sliding movement of the sash in the tracks and swinging movement of the sash in the window opening about the outer surfaces of the heads of said screws.

2. A sash as set forth in claim 1 wherein said joints are miter joints.

3. A sash as set forth in claim 1 wherein the screws are tapping screws.

4. A sash as set forth in claim 1 wherein said means at the outer end of the head of each screw comprises a recess in the outer face thereof adapted to receive said means for turning the screw.

5. A sash as set forth in claim 1 wherein the opening at the end of said cross member extends along the longitudinal axis thereof.

6. A sash as set forth in claim 5 wherein the hole in each side member extends through the side member transversely thereof.

7. A sash as set forth in claim 5 wherein each screw has at its inner end a generally cylindrical projection of a smaller diameter than the threaded shank of the screw, the projection being adapted to guide the entry of the screw into the opening in said cross member.

8. A sash as set forth in claim 5 wherein the opening in said cross member extends the length thereof.

9. A sash as set forth in claim 8 wherein the side and cross members are extrusions.

10. A sash as set forth in claim 1 wherein the securing means further comprises screws at the other two joints of the sash.

11. A sash as set forth in claim 10 wherein the screws at said other two joints have heads received in countersunk holes in the side members.

12. A sash as set forth in claim 10 wherein the said other two joints are miter joints.

* * * * *